US010845767B2

(12) United States Patent
Peterson et al.

(10) Patent No.: US 10,845,767 B2
(45) Date of Patent: Nov. 24, 2020

(54) WATCH FACE SELECTION

(71) Applicant: Lenovo (Singapore) Pte. Ltd., Singapore (SG)

(72) Inventors: Nathan J. Peterson, Oxford, NC (US); Russell Speight VanBlon, Raleigh, NC (US); John Carl Mese, Cary, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 15/793,974

(22) Filed: Oct. 25, 2017

(65) Prior Publication Data

US 2019/0121300 A1 Apr. 25, 2019

(51) Int. Cl.

| | |
|---|---|
| ***G04G 21/02*** | (2010.01) |
| ***G04G 99/00*** | (2010.01) |
| ***G04G 9/00*** | (2006.01) |

(52) U.S. Cl.

CPC ..... *G04G 99/006* (2013.01); *G04G 9/0064* (2013.01); *G04G 9/0076* (2013.01); *G04G 21/025* (2013.01)

(58) Field of Classification Search

CPC ..... G04G 99/00; G04G 9/00; G04G 9/0064; G04G 21/025; G04G 21/02; G04C 17/00; G04C 19/00

See application file for complete search history.

(56) References Cited

U.S. PATENT DOCUMENTS

| | | | | |
|---|---|---|---|---|
| 5,442,557 | A * | 8/1995 | Kaneko | G01C 21/3632 340/990 |
| 6,449,219 | B1 * | 9/2002 | Hepp | G04G 9/02 368/16 |
| 7,859,947 | B2 * | 12/2010 | Kawai | G04G 9/0011 345/2.3 |
| 9,939,784 | B1 * | 4/2018 | Berardinelli | G04B 37/1486 |
| 10,146,188 | B2 * | 12/2018 | Katzer | G04B 47/066 |
| 2006/0073851 | A1 * | 4/2006 | Colando | G04G 9/0064 455/566 |
| 2007/0258336 | A1 * | 11/2007 | Bailey | G04G 9/06 368/223 |
| 2009/0059731 | A1 * | 3/2009 | Bull | G04G 11/00 368/73 |
| 2009/0085865 | A1 * | 4/2009 | Fattah | G06F 1/1684 345/156 |
| 2013/0329528 | A1 * | 12/2013 | Botten | G04B 19/00 368/18 |
| 2015/0205509 | A1 * | 7/2015 | Scriven | G04G 21/08 715/834 |

(Continued)

OTHER PUBLICATIONS

Shapira, J. A., Watch Parts—A Glossary of Terms & Functions, Gentleman's Gazette, Nov. 8, 2013 (47 pages).

(Continued)

*Primary Examiner* — Sean Kayes
(74) *Attorney, Agent, or Firm* — Brian J. Pangrle

(57) ABSTRACT

A watch can include a processor; memory operatively coupled to the processor; a display operatively coupled to the processor; an environmental sensor that generates sensor information; circuitry that selects a watch face from a plurality of different watch faces based at least in part on at least a portion of the sensor information; and circuitry that renders the selected watch face to the display.

20 Claims, 10 Drawing Sheets

(56) References Cited

U.S. PATENT DOCUMENTS

| | | | | |
|---|---|---|---|---|
| 2016/0011653 | A1* | 1/2016 | Kotkajuuri | G06F 1/163 713/323 |
| 2016/0054791 | A1* | 2/2016 | Mullins | G04G 21/00 345/173 |
| 2016/0327915 | A1* | 11/2016 | Katzer | G04B 19/04 |
| 2016/0357151 | A1* | 12/2016 | Block | G04B 19/24 |
| 2017/0082983 | A1* | 3/2017 | Katzer | G04G 9/00 |
| 2017/0243385 | A1* | 8/2017 | Mitsugi | G04G 21/02 |
| 2017/0357426 | A1* | 12/2017 | Wilson | G06F 3/0482 |
| 2017/0357427 | A1* | 12/2017 | Wilson | G04G 9/02 |

OTHER PUBLICATIONS

Van Emden, Accelerometer step counter in R, Pavlov.tech, Nov. 30, 2015 (5 pages).
Developer.android.com, Building a Watch Face Service, Jan. 2016 (4 pages).
Developer.android.com, Creating Watch Faces, Jan. 2016 (2 pages).
Developer.android.com, Designing Watch Faces, Jan. 2016 (2 pages).

* cited by examiner

WATCH FACE SELECTION

TECHNICAL FIELD

Subject matter disclosed herein generally relates to watches.

BACKGROUND

Wearable devices include smart watches that can be worn on the arm of a user. For example, a smart watch can include a strap or a band that secures the smart watch to the wrist of a user.

SUMMARY

A watch can include a processor; memory operatively coupled to the processor; a display operatively coupled to the processor; an environmental sensor that generates sensor information; circuitry that selects a watch face from a plurality of different watch faces based at least in part on at least a portion of the sensor information; and circuitry that renders the selected watch face to the display. Various other methods, apparatuses, systems, etc., are also disclosed.

BRIEF DESCRIPTION OF THE DRAWINGS

Features and advantages of the described implementations can be more readily understood by reference to the following description taken in conjunction with examples of the accompanying drawings.

DETAILED DESCRIPTION

The following description includes the best mode presently contemplated for practicing the described implementations. This description is not to be taken in a limiting sense, but rather is made merely for the purpose of describing general principles of various implementations. The scope of invention should be ascertained with reference to issued claims.

Figure 1:
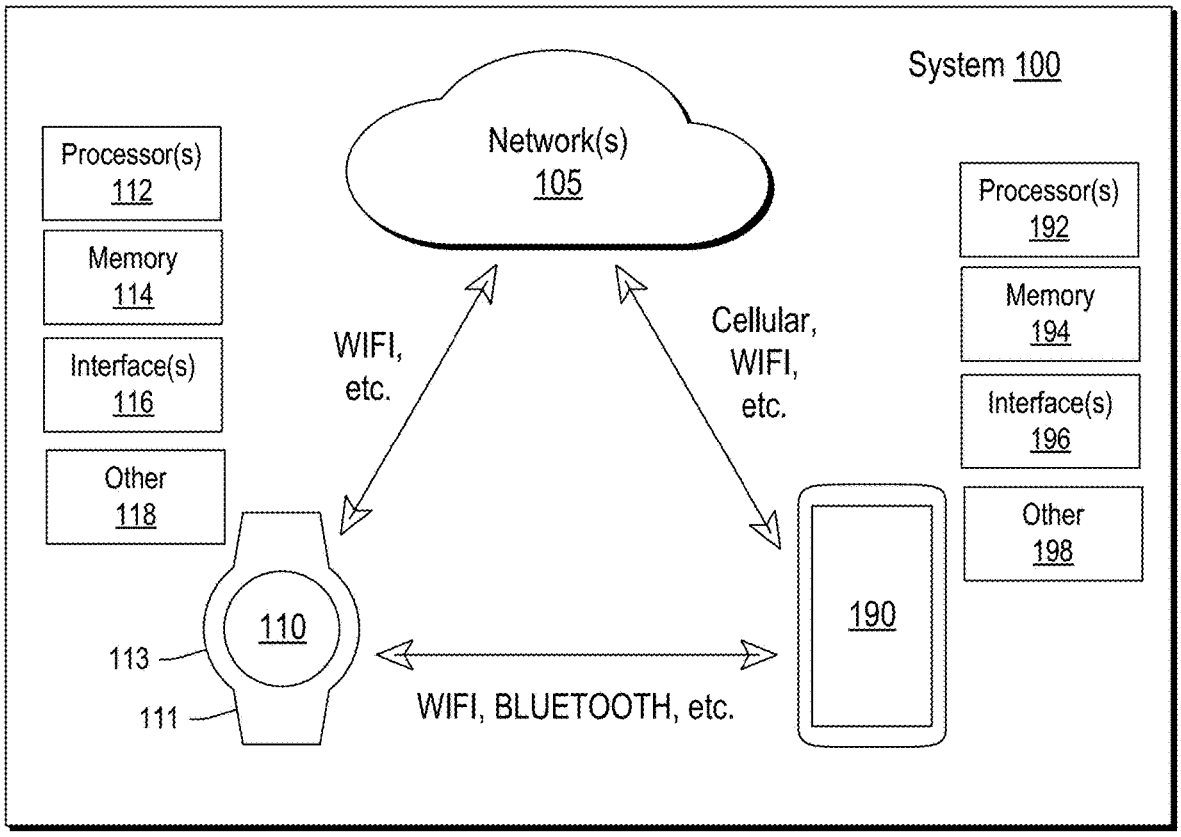
FIG. 1 is a series of diagrams of an example of a system and an example of a device.
Figure 1:
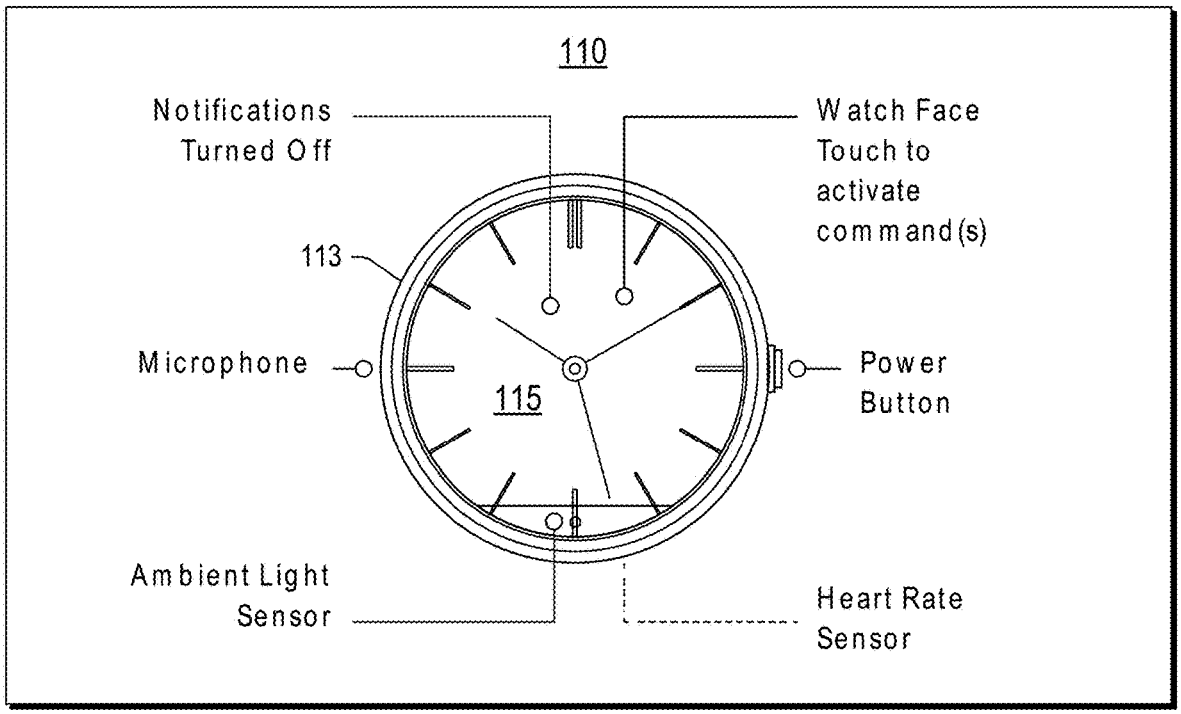

FIG. 1 shows an example of a system 100 that includes one or more networks 105, a watch 110 and a phone 190. As shown, the watch 110 can include one or more processors 112, memory 114, one or more interfaces 116 and one or more other components 118. As shown, the phone 190 can include one or more processors 192, memory 194, one or more interfaces 196 and one or more other components 198. As an example, a device can include a processor and memory operatively coupled to the processor. In such an example, the memory can store instructions executable by the processor to instruct the device to perform one or more actions. As an example, an interface may be a wireless communication interface (e.g., for transmission and/or reception of information).

As shown in the example of FIG. 1, the device 110 can include various components with associated functions. For example, the device 110 can include one or more of a microphone, a speaker, a light sensor, a physiological sensor (e.g., a heart rate sensor), an accelerometer, a power button (e.g., a power switch), a touch sensor, one or more lights such as a notification status light, etc. As an example, one or more of such components may be operatively coupled to a processor of the device (e.g., at least one of the one or more processors 112).

In the example of FIG. 1, the device 110 is physically configured as a watch such as a smart watch that includes a case 113 and a display 115 that can render information. The device 110 can include a notifications indicator, a touch sensitive surface, a power button, a microphone, an ambient light sensor, a heart rate sensor and/or one or more other features, components, etc.

As shown in the example of FIG. 1, the device 110 includes features of a watch and/or representations of features of a watch rendered to the display 115. For example, the device 110 can include one or more of Arabic numerals, Roman numerals, hour markers, minute markers, second markers, an arbor, a hand or hands, a bezel or bezels, a cyclops/magnifier window or windows, a calendar, a date, a day, a month, a year, a moon or moon phase, a sun or sun phase, a day/night indicator, an AM/PM indicator, a map or maps, a dial or dials (e.g., a main dial, a sub-dial, etc.), multiple time zone times, hunting time or times, a jump display, military time or times, a power reserve indicator (e.g., mechanical and/or battery), a stem, a lug, a tonneau, a case, a strap, a band, links, a buckle, a latch, a clasp, and a battery. As an example, the device 110 may include components and/or instructions for one or more complications. A complication or complicated watch is a watch that tells more than just the time. Complications can include one or more of a chronograph, an alarm and a calendars where a more intricate complication, which may be referred to as a grand complication, can include one or more of a perpetual calendar, a tourbillion, a minute repeater, etc.

The device 110 can be referred to as a horological device. Horology or horological refers to the science of measuring time and/or the art of making instruments for indicating time. The device 110 can be a wearable device. For example, the device 110 can be worn on an arm of an individual that is a human such that the device 110 is a wearable device. As an example, the device 110 can be configured according to a form factor, which can define one or more aspects of a device. For example, a smart phone can be configured according to a smart phone form factor, a tablet computer can be configured according to a tablet computer form factor, a laptop or notebook computer can be configured according to a laptop or notebook computer form factor, etc. A form factor can specify the size, configuration, or physical arrangement of a computing device. A form factor may be used in describing the size and/or arrangement of a device, a case or chassis, or one or more internal components, etc. The device 110 can be configured according to a smart watch (or smartwatch) form factor.

As shown in the example of FIG. 1, the device 110 includes a watch face, which is an arrangement of features that appear in the view shown in FIG. 1. In such an example, at least a portion of the features can be changed. For example, consider the watch face as including features that are rendered to the display 115 via information stored in memory of the device 110 (e.g., the memory 114). A watch face may be classified and the device 110 can be capable of rendering a selected watch face as selected from a plurality of watch faces.

As an example, the device 110 can include an operating system, which can be stored as instructions in the memory 114 that are executable by at least one of the one or more processors 112 to establish an operating system environment. As an example, one or more applications can be stored in the memory 114 (e.g., as instructions, etc.) where such applications can be executable in an established operating system environment. As an example, an application can be a watch face application that, when executed in an operating system environment, causes rendering of a watch face to the display 115 of the device 110.

As an example, an operating system (OS) may be an iOS™ operating system (Apple, Cupertino, Calif.), an ANDROID™ operating system (Google Inc., Mountain View, Calif.), etc.

As to the ANDROID™ OS, designing watch faces can include utilization of colors, dynamic backgrounds, animations, and data integration. A watch face can be interactive in that received information such as a touch signal may cause a change in one or more aspects of a watch face rendered to a display.

An application such as a watch face application can access one or more types of information such as, for example, patterns, data, etc. As an example, a watch face application can include instructions for accessing one or more background images, application code to retrieve data, application code to draw text and shapes over one or more background images, etc. As an example, a so-called ambient mode can utilize an ambient mode background image, which may be, for example, black or grey with no image. As an example, a background image can be of a screen density of hdpi of about 320 by about 320 pixels in size, which may fit a polygonal perimeter display (e.g., square, rectangular), a curved perimeter display (e.g., round, oval, etc.), etc.; noting that a display may be curved with a polygonal perimeter and/or a curved perimeter. As an example, an application may scale down a background image in a manner dependent on display resolution. As an example, an image may be a bitmap image.

As an example, a watch face application can execute to retrieve one or more types of contextual data, for example, as often as desired (e.g., or required) and, for example, to store results to reuse the data upon rendering a watch face (e.g., such that fetching of weather updates can be timed as appropriate, etc.). As an example, to increase battery life, application code that renders a watch face, particularly in an ambient mode, may be simplified as to features. In an interactive mode, a fuller set of features may be utilized (e.g., more color, complex shapes, gradients, animations, etc.), though power utilization can be increased.

In the ANDROID™ OS, watch faces are defined as services that are packaged inside a wearable app (e.g., an application for a wearable device). When a user selects an available one of available watch faces, the wearable device shows the watch face and invokes its service callback methods as in the ANDROID™ OS. When a user installs a wearable app with one or more watch faces, the one or more watch faces become available in a watch face picker feature of the wearable device.

Again, referring to the ANDROID™ OS, watch faces are implemented as services. When a watch face is active, methods are invoked in the watch face's service, for example, when the time changes or when an event occurs (e.g., switching to an ambient mode, receiving a new notification, etc.). In response to an event, the service implementation renders the watch face to the display of the wearable device, for example, using the updated time and/or other relevant data.

In the ANDROID™ OS, implementation of a watch face involves extending the CanvasWatchFaceService and CanvasWatchFaceService.Engine classes and overriding callback methods in the CanvasWatchFaceService.Engine class. Such classes are included in the Wearable Support Library.

The following example snippet of code outlines methods that can be implemented in the ANDROID™ OS:

```
public class AnalogWatchFaceService extends
CanvasWatchFaceService
{
    @Override
    public Engine onCreateEngine( ) {
      /* provide your watch face implementation */
      return new Engine( );
    }
    /* implement service callback methods */
    private class Engine extends CanvasWatchFaceService.Engine {
      @Override
      public void onCreate(SurfaceHolder holder) {
        super.onCreate(holder);
        /* initialize your watch face */
      }
      @Override
      public void onPropertiesChanged(Bundle properties) {
        super.onPropertiesChanged(properties);
        /* get device features (burn-in, low-bit ambient) */
      }
      @Override
      public void onTimeTick( ) {
        super.onTimeTick( );
        /* the time changed */
      }
      @Override
      public void onAmbientModeChanged(boolean inAmbientMode) {
        super.onAmbientModeChanged(inAmbientMode);
        /* the wearable switched between modes */
      }
      @Override
      public void onDraw(Canvas canvas, Rect bounds) {
        /* draw your watch face */
      }
      @Override
      public void onVisibilityChanged(boolean visible) {
        super.onVisibilityChanged(visible);
        /* the watch face became visible or invisible */
      }
    }
}
```

Referring again to FIG. 1, where the device 190 can be, for example, a smart phone, a method can include selecting a watch face or watch faces from the device 190. For example, a companion application may be installed on the device 190 that can be executed on the device 190 to allow for transmission of information from the device 190 to the device 110, and optionally from the device 110 to the device 190, for selection of one or more watch faces.

A smart watch may be statically set to show a specific amount of information such that a user can set the smart watch to show only the time or such that the user can add one or more other parameters such as temperature, barometric pressure, step counter, etc. Such static settings do not change based on what a user may be doing. In certain circumstances, if a user wants the watch face to transition to a work-out mode (e.g., a type of exercise mode, etc.), then the user would have to change the screen layout in order to get to the watch face she desires. In such a situation, the user instructs the smart watch through one or more interactions such as a touch interaction that may touch a display or another part of the smart watch. A user may have to navigate one or more menus to find a desired setting that has a corresponding watch face. Where a user forgets to change a smart watch's mode during an activity (e.g., fails to manipulate the smart watch to implement a desired mode), that activity may not be logged (e.g., as activity data, etc.), which may be detrimental to a user's experience, particularly if the user wants to track his activity.

As explained, a smart watch can require manipulation (e.g., touch, transmission of an instruction, etc.) to change a watch face (e.g., to see different data based on what a user is doing).

As an example, a watch can include a processor; memory operatively coupled to the processor; a display operatively coupled to the processor; an environmental sensor that generates sensor information; circuitry that selects a watch face from a plurality of different watch faces based at least in part on at least a portion of the sensor information; and circuitry that renders the selected watch face to the display. In such an example, the watch can be a device such as the device 110 of FIG. 1.

As an example, a method can include detecting a change in environment of a watch that includes a display; responsive to the change, selecting a watch face from a plurality of different watch faces; and rendering the selected watch face to the display. In such an example, the watch can be a device such as the device 110 of FIG.

As an example, a watch may respond to a user's context by selecting a watch face from a plurality of watch faces and rendering the selected watch face to a display of the watch. As an example, during the course of a day, a user may move in a manner that generates contextual information (e.g., contextual data) via one or more sensors of a watch. Such contextual information may, for example, be classified where a classification can correspond to a particular watch face. In such an example, as contextual information changes, a watch can respond by selecting a watch face from a plurality of watch faces that is linked to a user context that generated the contextual information. During the course of a day, a watch may automatically change its watch face a plurality of times as a user changes context. For example, consider the following example activities:

TABLE 1

Examples of Activities

| Time | Activity | Contextual Data | Watch Face |
|---|---|---|---|
| 7:00 AM | Waking from Bed | Motion | Schedule |
| 8:15 AM | Travel to Workplace | Motion, GPS, WiFi | Executive |
| 3:00 PM | Exercise | Motion, Temp, Etc. | Exercise |
| 4:35 PM | Outdoors | Light, Temp, Etc. | Weather |
| 6:52 PM | Shopping | Motion | Shopping |
| 11:06 PM | None | Motion | Morning Alarm |

As an example, where a watch determines that a user is now running, walking, exercising, etc., the watch could change its watch face automatically to a work-out mode watch face that could show steps, calorie count, etc.

As an example, if a user is traveling and moves across time zones, a watch can change its watch face automatically to a watch face that includes the current time zone as well as the home time zone.

As an example, if a predetermined change occurs in weather in a user's local environment, a watch can select and render a watch face that has a weather theme. As an example, if a change occurs in environment of a watch, the watch may select and render a watch face based on sensor information indicative of the change in environment (e.g., a predetermined amount of change in temperature, light, etc.). As an example, consider a user that exits a heated building in the winter where a temperature drop may be sensed by a temperature sensor of a watch, in such an example, the watch may select and render a watch face that displays the temperature. A user may read the temperature and know that driving conditions may be hazardous (e.g., due to ice, etc.). As an example, a user may enter a building from an exterior environment where a watch senses a change in lighting, in such an example, the watch may select and render a watch face based at least in part on sensed information as to lighting (e.g., type of light, amount of light, etc.). In such an example, the selected watch face may be a professional watch face that may render information and/or a style that is suited to the user's profession, vocation, etc. As an example, a user may have a personal theme such as a TRANSFORMERS™ theme that may not be appropriate for conveying a desired professional appearance. In such an example, when going into a professional setting that can be determined based at least in part on sensor data, a watch can change its watch face to a more professional watch face (e.g., from the TRANSFORMERS™ theme to a ROLEX™ theme).

The decision to change a watch face during a particular context may be preprogrammed or, for example, it may be learned based on past behavior. As an example, after implementation of a selected temporary watch mode, a watch may default back to its standard watch face, which may not normally include steps, weather, etc. As an example, a watch can have a default watch face and one or more other watch faces that can be selected and rendered by the watch based at least in part on sensor information that corresponds to a user's context.

As an example, a wearable device may store information about a user's activities and selected watch faces where such information may be utilized in a machine learning process. In such an example, the wearable device may progressively learn to facilitate selection and rendering of a watch face based on user activity, time of day, day of the week, etc. For example, a table such as Table 1 may be generated and stored in memory of a wearable device such that the wearable device can progressively learn what watch face to select and render to a display of the wearable device of a user. As an example, a wearable device may store activity information along with input information. In such an example, input information may include touch input that selects a menu item to cause the wearable device to select and render a particular watch face and activity information may be that of the time of selection, before selection and/or after selection. In such an example, the wearable device may learn that a certain type of activity information is associated with a user selecting a particular watch face (e.g., watch face application, etc.). Upon sufficient learning (e.g., of the order of weeks), the wearable device may determine that a user is likely to select a particular watch face based on activity information and proactively select and render that particular watch face to a display of the wearable device.

Figure 2:
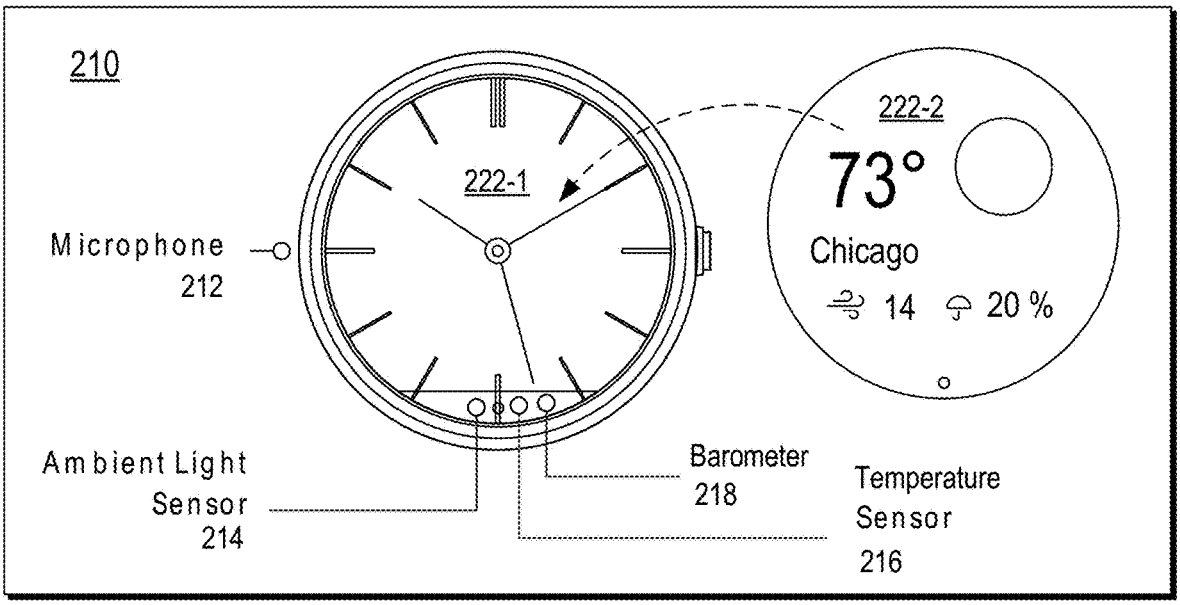
FIG. 2 is a series of diagrams of an example of a device, an example of a plot and an example of a method.
Figure 2:
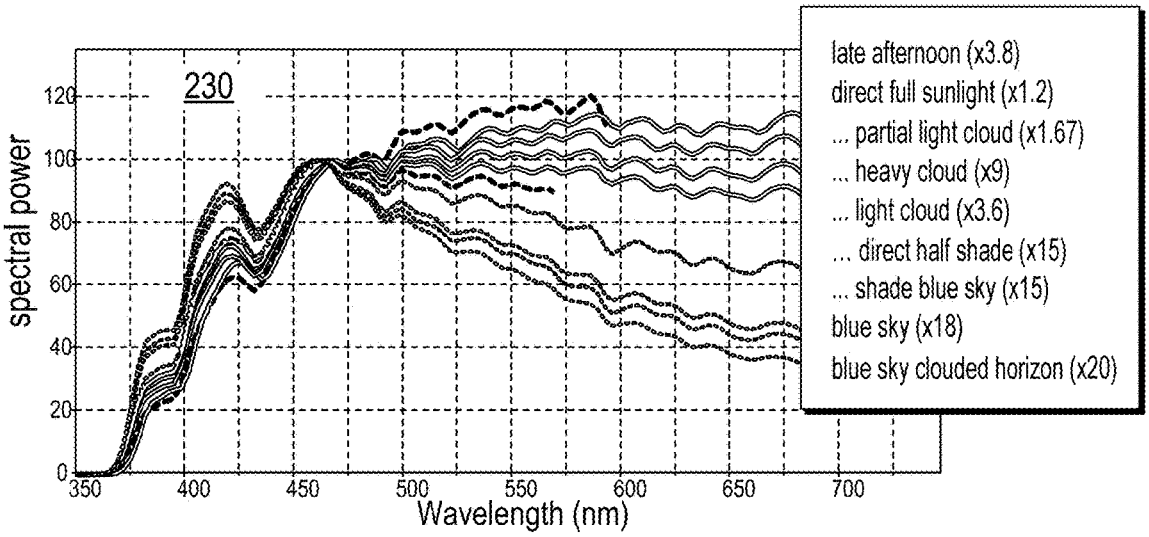
Figure 2:
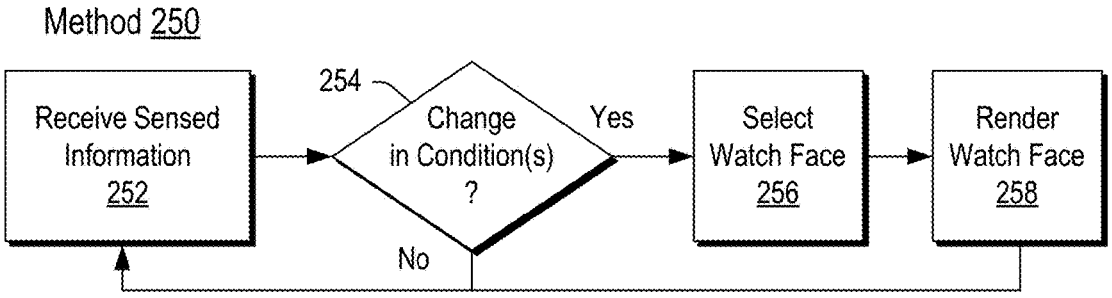

FIG. 2 shows an example of a device 210 that includes a microphone 212, an ambient light sensor 214, a temperature sensor 216 and a barometer 218. One or more of such sensors and/or one or more other sensors may sense information that can cause the device 210 to select and render a watch face. For example, the device 210 is shown as including a watch face 222-1 that may transition to the watch face 222-2 in response to a change in one or more conditions (e.g., light, temperature, pressure, etc.). As shown, the watch face 222-2 has a weather theme, as it displays various weather related information (e.g., temperature, sun/clouds, wind, chance of rain, etc.).

As to ambient light, the sensor 214 may determine one or more aspects of sensed light. For example, consider a plot 230 of spectral power versus wavelength where different types of light exhibit different spectral power at various wavelengths. In such an example, the device 210 may determine that sensed light corresponds to heavy clouds. In such an example, where a prior sensed light within a period of time of the order of minutes (e.g., greater than several minutes and less than about 120 minutes) corresponded to direct full sunlight (e.g., or other fair weather condition), the device 210 may render a weather themed watch face that includes a field (e.g., a region) for rendering of weather service warning information. In such an example, temperature and/or barometer information may be utilized in making a decision as to whether to select and render a particular weather themed watch face. For example, a change in light along with one or more of a drop in temperature and a drop in pressure may indicate that a storm front has arrived or is approaching.

FIG. 2 shows an example of a method 250 that includes a reception block 252 for receiving sensed information via one or more watch sensors of a watch, a decision block 254 for deciding if a change in one or more conditions occurred as evidenced by at least a portion of the sensed information, a selection block 256 for selecting a watch face from a plurality of watch faces, and a render block 258 for rendering the selected watch face to a display of the watch. In such an example, the sensed information may be weather related information and the selected watch face may be a weather themed watch face. As shown in FIG. 2, the method 250 may operate in a loop, for example, in a continuous manner that receives information per the reception block 252 such that selections and renderings of a watch face can occur based at least in part on at least a portion of such received information.

Figure 3:
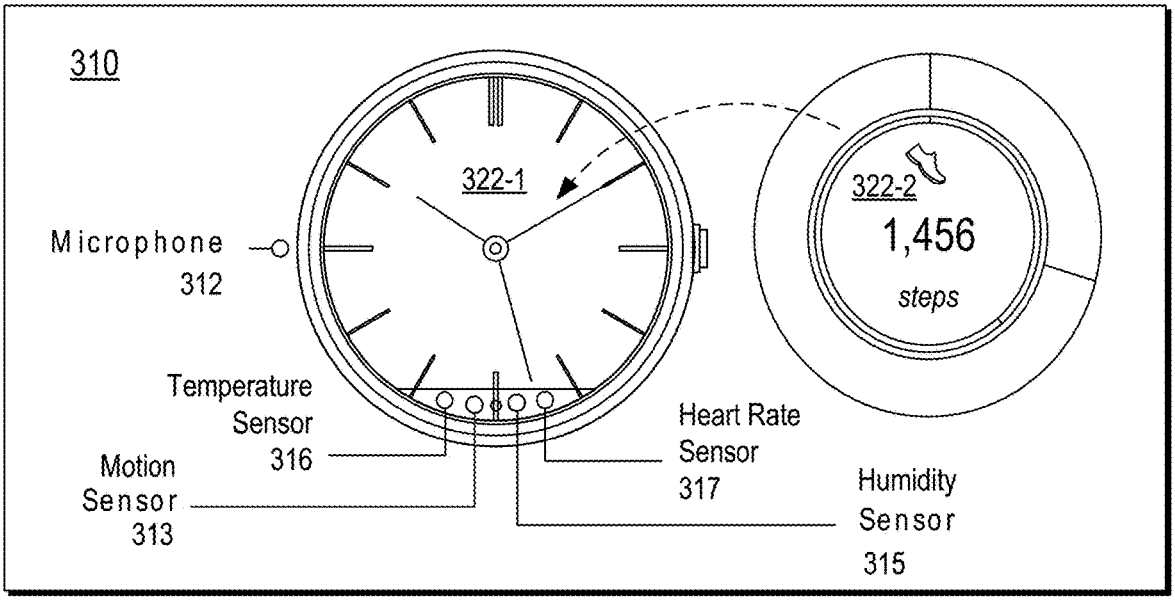
FIG. 3 is a series of diagrams of an example of a device, examples of plots and an example of a method.
Figure 3:
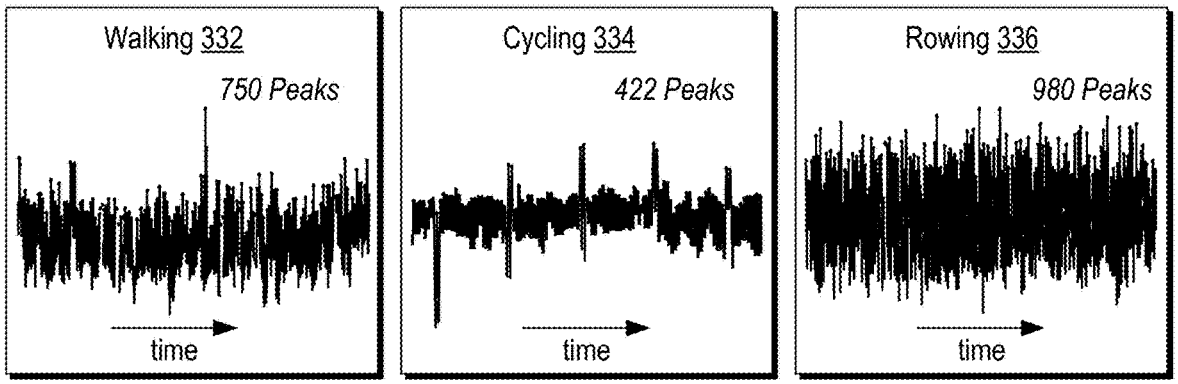
Figure 3:
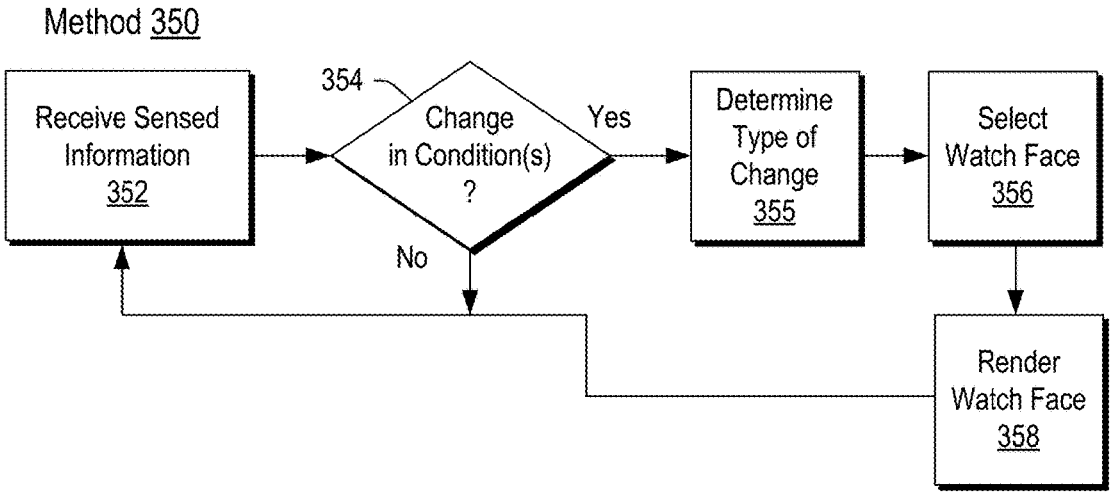

FIG. 3 shows an example of a device 310 that includes a microphone 312, a motion sensor 313, a humidity sensor 315, a temperature sensor 316 and a heart rate sensor 317. One or more of such sensors and/or one or more other sensors may sense information that can cause the device 310 to select and render a watch face. For example, the device 310 is shown as including a watch face 322-1 that may transition to the watch face 322-2 in response to a change in one or more conditions. As shown, the watch face 322-2 has an exercise theme, as it displays various exercise related information (e.g., activity metrics, etc.).

As to the motion sensor 313, it can include one or more of a gyroscope and an accelerometer. For example, the motion sensor 313 can include a multi-axis accelerometer that can sense motion of the device 310, which can be strapped to an arm of a user (e.g., as a wearable device).

FIG. 3 shows example plots 332, 334 and 336 of various types of motion data as acquired by a motion sensor such as the motion sensor 313. As shown, the plot 332 corresponds to walking motion, the plot 334 corresponds to cycling motion and the plot 336 corresponds to rowing motion. Such different types of motion (e.g., exercise activities) exhibit different types of motion signals. For example, peaks and magnitude of peaks may be determined from sensor signals with respect to time. As an example, the device 310 can include circuitry that can analyze sensor data (e.g., sensor signals, etc.) to classify the sensor data as being associated with a particular type of activity (e.g., walking, cycling, rowing, etc.). In response, the device 310 can select a corresponding type of watch face that is associated with the classification (e.g., a particular type of activity).

FIG. 3 shows an example of a method 350 that includes a reception block 352 for receiving sensed information via one or more watch sensors of a watch, a decision block 354 for deciding if a change in one or more conditions occurred as evidenced by at least a portion of the sensed information, a determination block 355 for determining a type of change (e.g., a type of activity, etc.), a selection block 356 for selecting a watch face from a plurality of watch faces based at least in part on the determined type of change, and a render block 358 for rendering the selected watch face to a display of the watch. In such an example, the sensed information may be activity related information and the selected watch face may be an exercise themed watch face. As shown in FIG. 3, the method 350 may operate in a loop, for example, in a continuous manner that receives information per the reception block 352 such that selections and renderings of a watch face can occur based at least in part on at least a portion of such received information.

Figure 4:
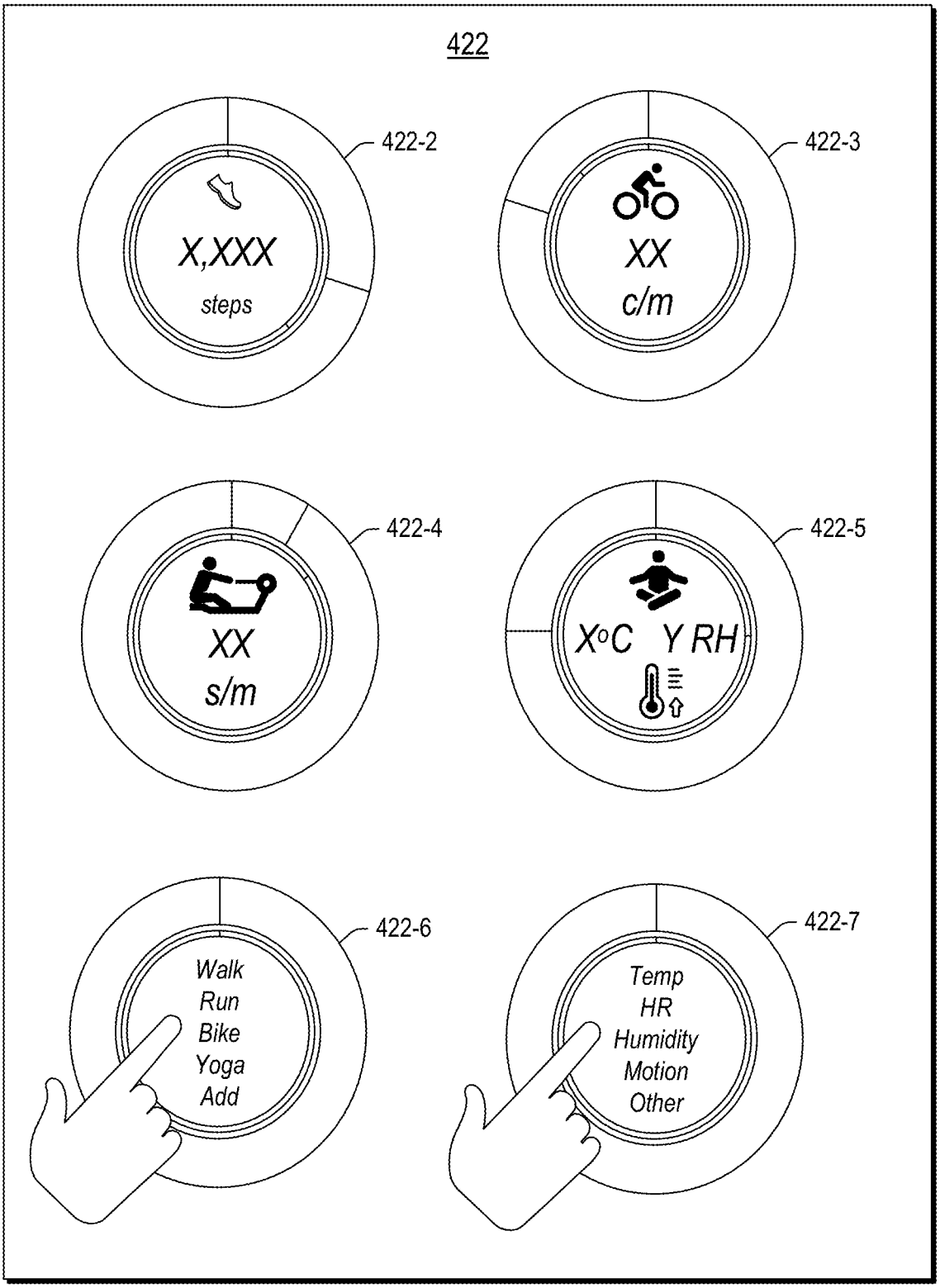
FIG. 4 is a series of diagrams of examples of watch faces.

FIG. 4 shows various examples of watch faces 422 where a watch face 422-2 can render information as to walking (e.g., number of steps, etc.), a watch face 422-3 can render information as to cycling (e.g., cycles per minute, etc.), a watch face 422-4 can render information as to rowing (e.g., strokes per minute, etc.), and a watch face 422-5 can render information as to yoga (e.g., temperature and/or relative humidity). As to the example watch face 422-5, it may be selected and rendered when a user enters a yoga studio, which may be a hot yoga studio where temperature may be elevated as well as relative humidity. In such an example, a watch can include a temperature sensor and/or relative humidity sensor that can sense a change in a condition or conditions (e.g., one or more environmental conditions). In response, the watch may automatically select and render a yoga themed watch face. In such an example, the watch may include one or more physiology sensors such as a body/skin temperature sensor, a heart rate sensor, a breathing rate sensor (e.g., optionally via one or more of blood oxygen level, changes in breathing where exhaling lowers heart rate and inhaling increases heart rate, etc.) and/or one or more other types of sensors.

As shown in FIG. 4, a watch face can render one or more menus, which may be associated with an activity (e.g., a mode) and/or a sensor. For example, a watch face 422-6 can render a graphical user interface (GUI) to a display of a watch that allows for receipt of input (e.g., touch input, etc.) to select an activity (e.g., walk, run, bike, yoga, add, etc.). Such a watch face may be selected and rendered where a watch determines that a user is engaged in an activity but the watch cannot adequately resolve the data to determined what type of activity (e.g., unable to classify type of exercise activity). As an example, a sensor type menu may be rendered as a GUI to a display as shown via the watch face 422-7. Such a menu may be utilized to cause a selected watch face associated with a theme to render particular sensor-based information to the display. For example, consider a menu to select temperature sensor-based information, heart rate sensor-based information, humidity sensor-based information, motion sensor-based information, and/or other sensor-based information.

Figure 5:
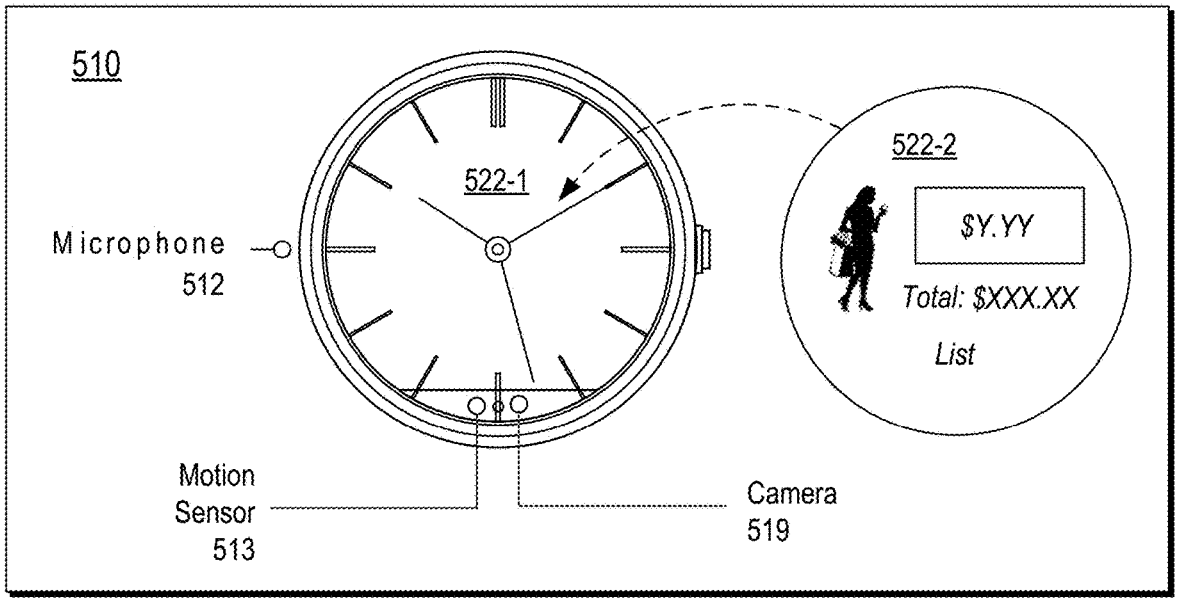
FIG. 5 is a series of diagrams of an example of a device, an example of a method and an example of another method.
Figure 5:
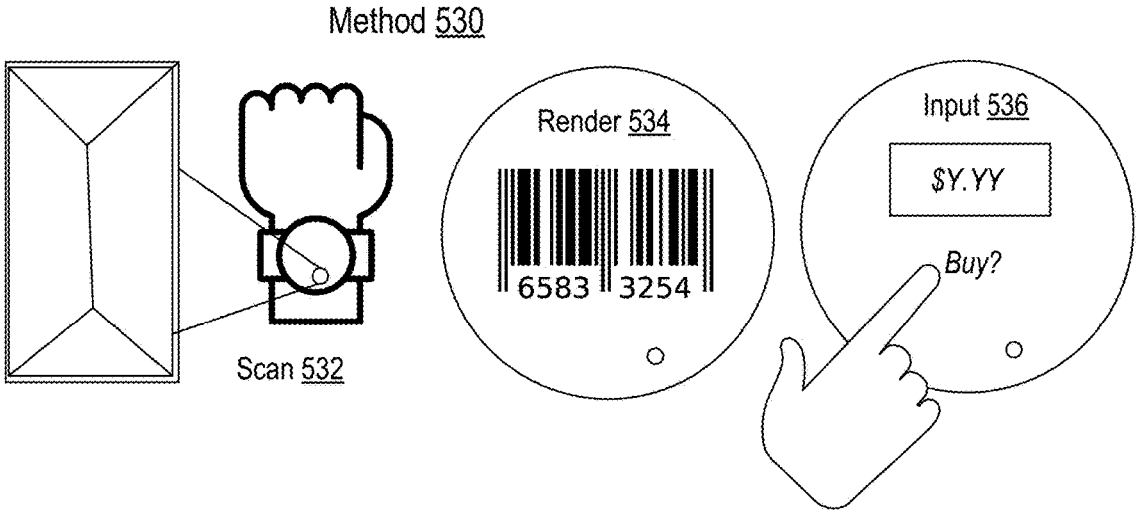
Figure 5:
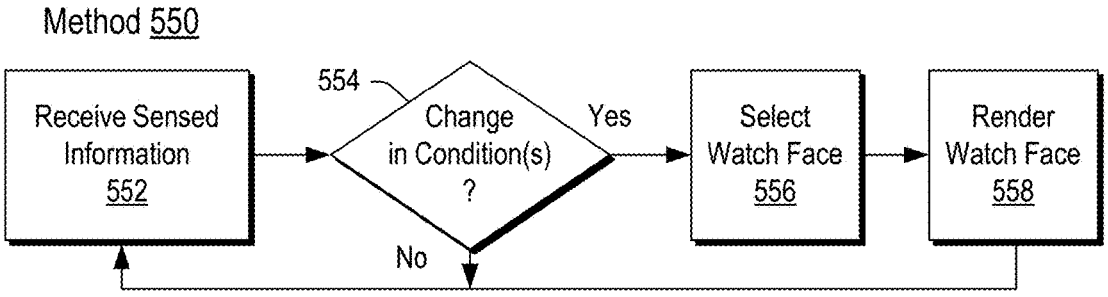

FIG. 5 shows an example of a device 510 that includes a microphone 512, a motion sensor 513 and a camera 519. One or more of such sensors and/or one or more other sensors may sense information that can cause the device 510 to select and render a watch face. For example, the device 510 is shown as including a watch face 522-1 that may transition to the watch face 522-2 in response to a change in one or more conditions. As shown, the watch face 522-2 has a shopping theme, as it displays various shopping related information (e.g., price, total of items, list of items, etc.).

As to the motion sensor 513, it can include one or more of a gyroscope and an accelerometer. For example, the motion sensor 513 can include a multi-axis accelerometer that can sense motion of the device 510, which can be strapped to an arm of a user (e.g., as a wearable device).

FIG. 5 shows an example of a method 530 that includes a scan block 532 for scanning a code of a product utilizing the camera 519 of the device 510, a render block 534 for rendering the scanned code to a display of the device 510 and an input block 536 for receiving input via the device 510, for example, utilizing a graphical user interface associated with the shopping themed watch face. In such an example, the method 530 can include executing an application associated with the selected and rendered watch face. Such an application may include a variety of associated features, such as one or more GUIs. In the example of FIG. 5, the method 530 can include receiving a "buy" input that can cause a total to be updated (see, e.g., the total of the watch face 522-2). In such an example, the default watch face of the shopping themed application may be the watch face 522-2, which is selected and rendered responsive to sensed motion by the motion sensor 513. For example, consider a user reaching for a product on a shelf. Such a motion may be sensed by the motion sensor 513 of the device 510 and be analyzed to determine that the user is likely shopping. With such a determination, the device 510 can select and render the watch face 522-2 to its display and execute an associated shopping application (e.g., the watch face 522-2 may be part of the shopping application).

FIG. 5 shows an example of another method 550 that includes a reception block 552 for receiving sensed information via one or more watch sensors of a watch, a decision block 554 for deciding if a change in one or more conditions occurred as evidenced by at least a portion of the sensed information, a selection block 556 for selecting a watch face from a plurality of watch faces based at least in part on the change, and a render block 558 for rendering the selected watch face to a display of the watch. In such an example, the sensed information may be activity related information and the selected watch face may be a shopping themed watch face. As shown in FIG. 5, the method 550 may operate in a loop, for example, in a continuous manner that receives information per the reception block 552 such that selections and renderings of a watch face can occur based at least in part on at least a portion of such received information.

Figure 6:
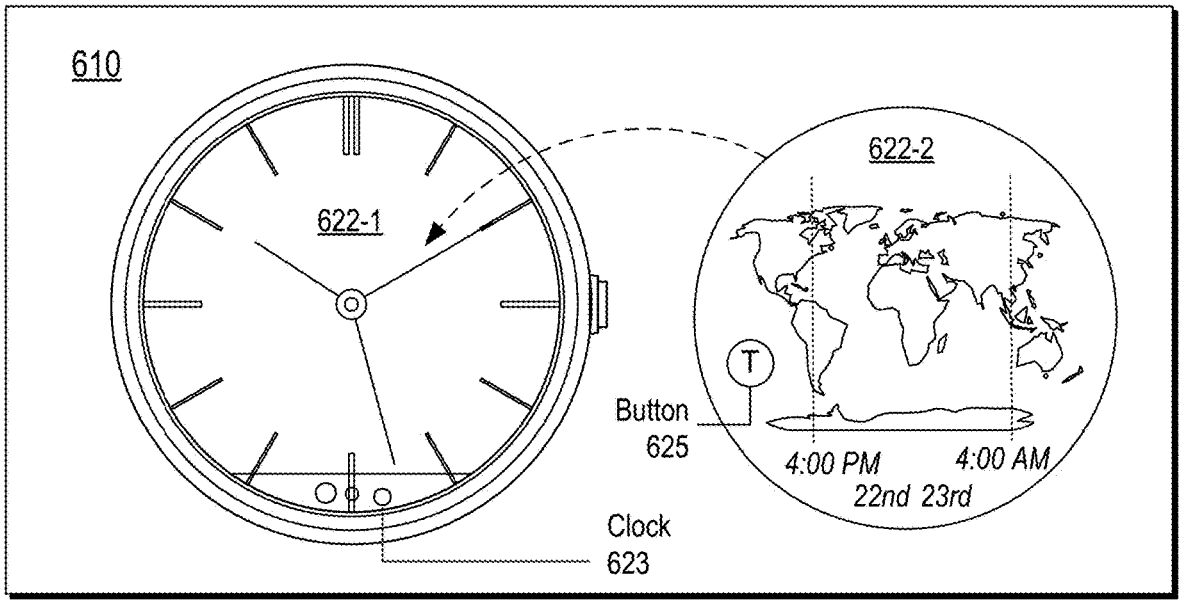
FIG. 6 is a series of diagrams of an example of a device, examples of graphical user interfaces and an example of another method.
Figure 6:
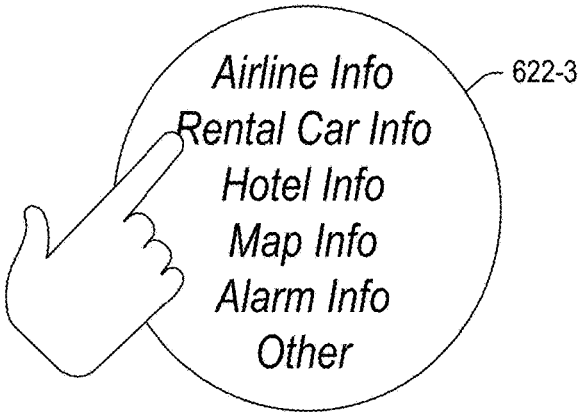
Figure 6:
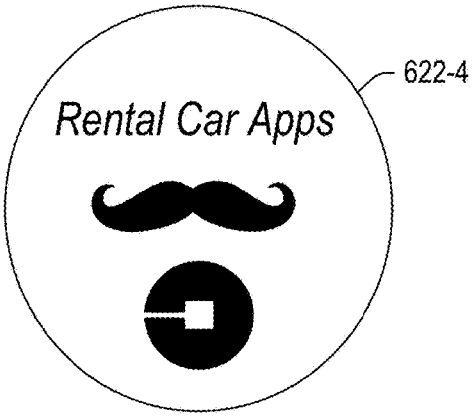
Figure 6:
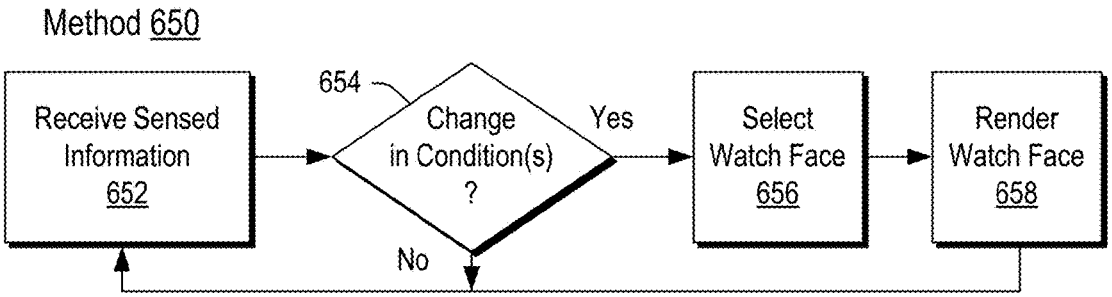

FIG. 6 shows an example of a device 610 that includes a clock 623 (e.g., a time sensor). One or more of such sensors and/or one or more other sensors may sense information that can cause the device 610 to select and render a watch face. For example, the device 610 is shown as including a watch face 622-1 that may transition to the watch face 622-2 in response to a change in one or more conditions. As shown, the watch face 622-2 has a time zone theme, as it displays various time zone related information (e.g., time in a time zone, boundaries of a time zone, etc.); whereas the watch face 622-1 shows a single time as in a single time zone. In the example of FIG. 6, the watch face 622-1 shows time in an analog representation via hands, which can include an hour hand, a minute hand and a second hand; whereas, the watch face 622-2 shows time in a digital representation via numeral (e.g., 4:00 PM EST and 4:00 AM SGT, which can be indicated as being a day ahead of EST, see "23rd" and "22nd").

As an example, the device 610 may include a barometer and/or an altimeter that can determine that a wearer of the device 610 is in a cabin of an airplane, which may be, for example, pressurized to a particular cabin pressure, which may be achieved over a period of time.

Cabin pressurization is a process in which conditioned air is pumped into the cabin of an aircraft to create a safe and comfortable environment for passengers and crew flying at high altitudes. For aircraft, this air may be bled off from a gas turbine engine at a compressor stage and cooled, humidified, and mixed with recirculated air if desired before it is distributed to the cabin by one or more environmental control systems. The cabin pressure may be regulated by an outflow valve. As an example, the device 610 may sense information that can determine that a wearer is in a cabin of an airplane via one or more of temperature, humidity, pressure, etc. In such an example, the device 610 may select and render a watch face that is associated with travel (e.g., air travel, etc.).

In the example of FIG. 6, the watch face 622-2 can be part of a watch face application that can include one or more graphical controls and/or other types of controls that may navigate one or more features, options, etc., of the watch face application. For example, the watch face 622-2 is shown as including a graphical control or button 625 that may include an appropriate indicator (e.g., "T" for travel). In such an example, a user may touch the button 625 to cause the watch face application to render a menu watch face 622-3, which can include travel related information such as airline information, rental car information, hotel information, map information, alarm information and/or other information. In such an example, a user may touch a menu item of the menu watch face 622-3 such that the watch face application renders the watch face 622-4, which can include, for example, icons for one or more associated services (e.g., rental car apps, etc.). Upon receiving input for one of the icons, the device 610 may instantiate the associated rental car app.

As to the clock 623, it may be a digital clock, which may be a real-time clock/calendar (RTC) chip that includes an oscillator that can count time. As an example, a digital clock may be a quartz clock. As an example, a digital clock may be set according to a signal. For example, consider a radio-controlled clock (RCC) that includes an antenna that picks up radio signals and a circuit that decodes them. Such a clock can use the radio signals to determine an appropriate time and adjust the time displayed by a watch accordingly.

As an example, a watch can include memory that stores one or more entries as to time, day, date, etc. For example, consider a calendar with entries that are stored in memory of a watch or, for example, a smartphone that is operatively coupled to the watch (e.g., wirelessly). As an example, a watch can include selecting and rendering a watch face based on one or more calendar entries. For example, where a watch stores a calendar for a user to go to the gym at 7:00 am, the watch may select a watch face from a plurality of watch faces where the selected watch face corresponds to a gym theme (e.g., an activity theme). To change to another watch face, the watch may utilize a calendar entry and/or one or more other types of information such as activity (e.g., motion, etc.). For example, where a motion sensor of a watch senses information indicative of a change from being more active to less active, the watch may analyze such information to determine that the gym entry is over and that the watch is to default to a default watch face; unless overridden by one or more other types of information (e.g., as associated with one or more other selectable watch faces).

FIG. 6 shows an example of another method 650 that includes a reception block 652 for receiving sensed information via one or more watch sensors of a watch, a decision block 654 for deciding if a change in one or more conditions occurred as evidenced by at least a portion of the sensed information, a selection block 656 for selecting a watch face from a plurality of watch faces based at least in part on the change, and a render block 658 for rendering the selected watch face to a display of the watch. In such an example, the sensed information may be activity related information and the selected watch face may be a world-time themed watch face. As shown in FIG. 6, the method 650 may operate in a loop, for example, in a continuous manner that receives information per the reception block 652 such that selections and renderings of a watch face can occur based at least in part on at least a portion of such received information.

Figure 7:
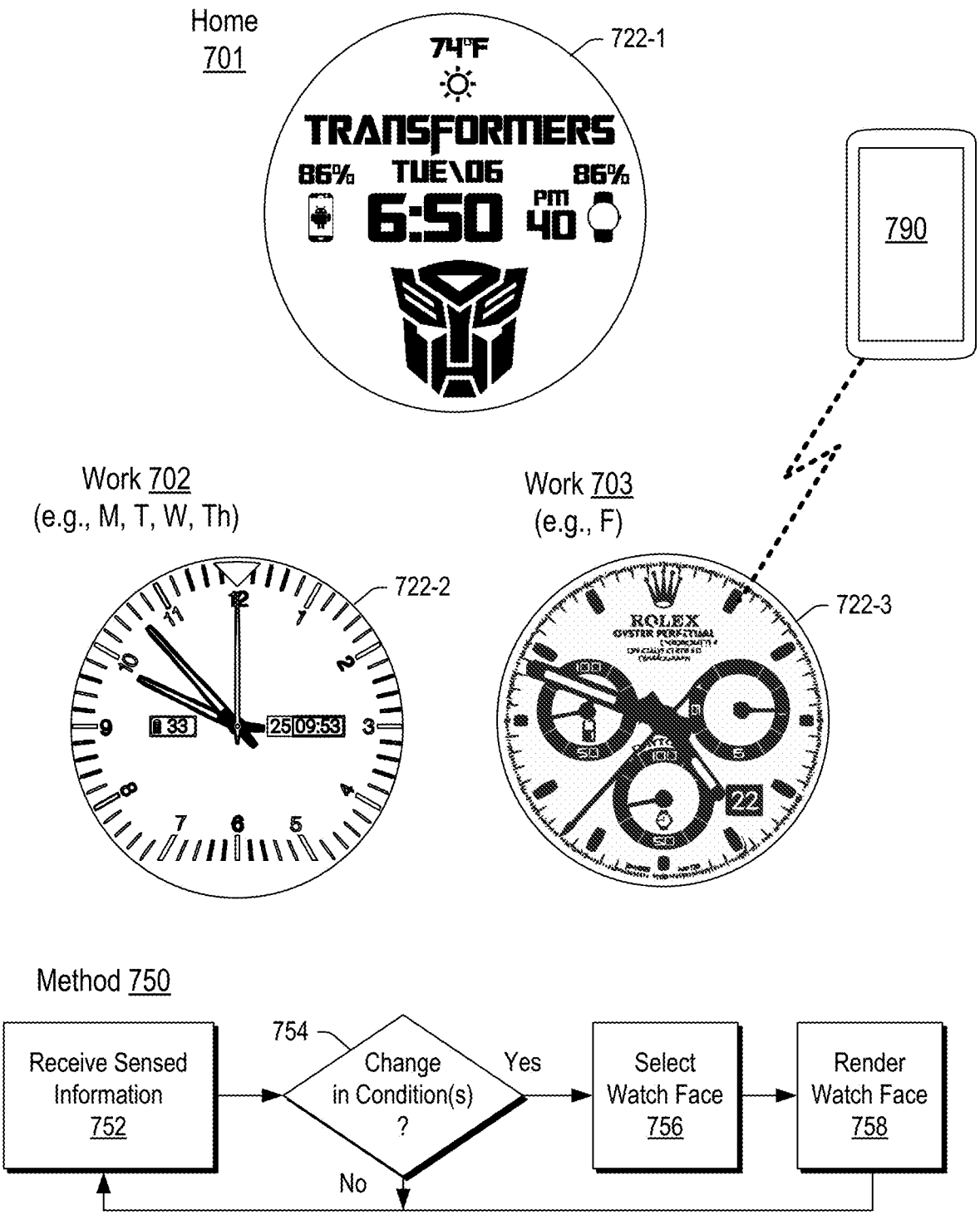
FIG. 7 is a series of diagrams of examples of watch faces associated with examples of environments, an example of a device, and an example of a method.

FIG. 7 shows examples of watch faces 722-1, 722-2 and 722-3 that are associated with different conditions (e.g., differential environmental conditions, etc.). The various conditions include a home environment 701, a work environment 702 and a work environment 703. In the example of FIG. 7, the work environment 702 can be associated with the watch face 722-2 and the work environment 703 can be associated with the watch face 722-3. As an example, one or more conditions may determine whether the watch face 722-2 or the watch face 722-3 is rendered to a display of a wearable device. For example, the watch face 722-2 may be a Monday, Tuesday, Wednesday, and Thursday watch face and the watch face 722-3 may be a Friday watch face.

As an example, a device 790 may be a portable device such as a smart phone (see, e.g., the device 190 of FIG. 1). In such an example, a wireless leash or a wireless tether may be established between the device 790 and a wearable device such as a smart watch (see, e.g., the device 110 of FIG. 1). In such an example, the device 790 may be a work device (e.g., a work smart phone) where a wireless leash or wireless tether does not exist, the watch face of the smart watch may automatically be selected and rendered in a personalized form such as the watch face 722-1; whereas, upon tethering/leashing of the smart watch to the work device, a selected on of the watch faces 722-2 and 722-3 may be rendered to a display of the smart watch.

FIG. 7 shows an example of a method 750 that includes a reception block 752 for receiving sensed information via one or more watch sensors of a watch, a decision block 754 for deciding if a change in one or more conditions occurred as evidenced by at least a portion of the sensed information, a selection block 756 for selecting a watch face from a plurality of watch faces based at least in part on the change, and a render block 758 for rendering the selected watch face to a display of the watch. In such an example, the sensed information may be environment related information and the selected watch face may be a casual themed watch face or a professional themed watch face. As shown in FIG. 7, the method 750 may operate in a loop, for example, in a continuous manner that receives information per the reception block 752 such that selections and renderings of a watch face can occur based at least in part on at least a portion of such received information.

Figure 8:
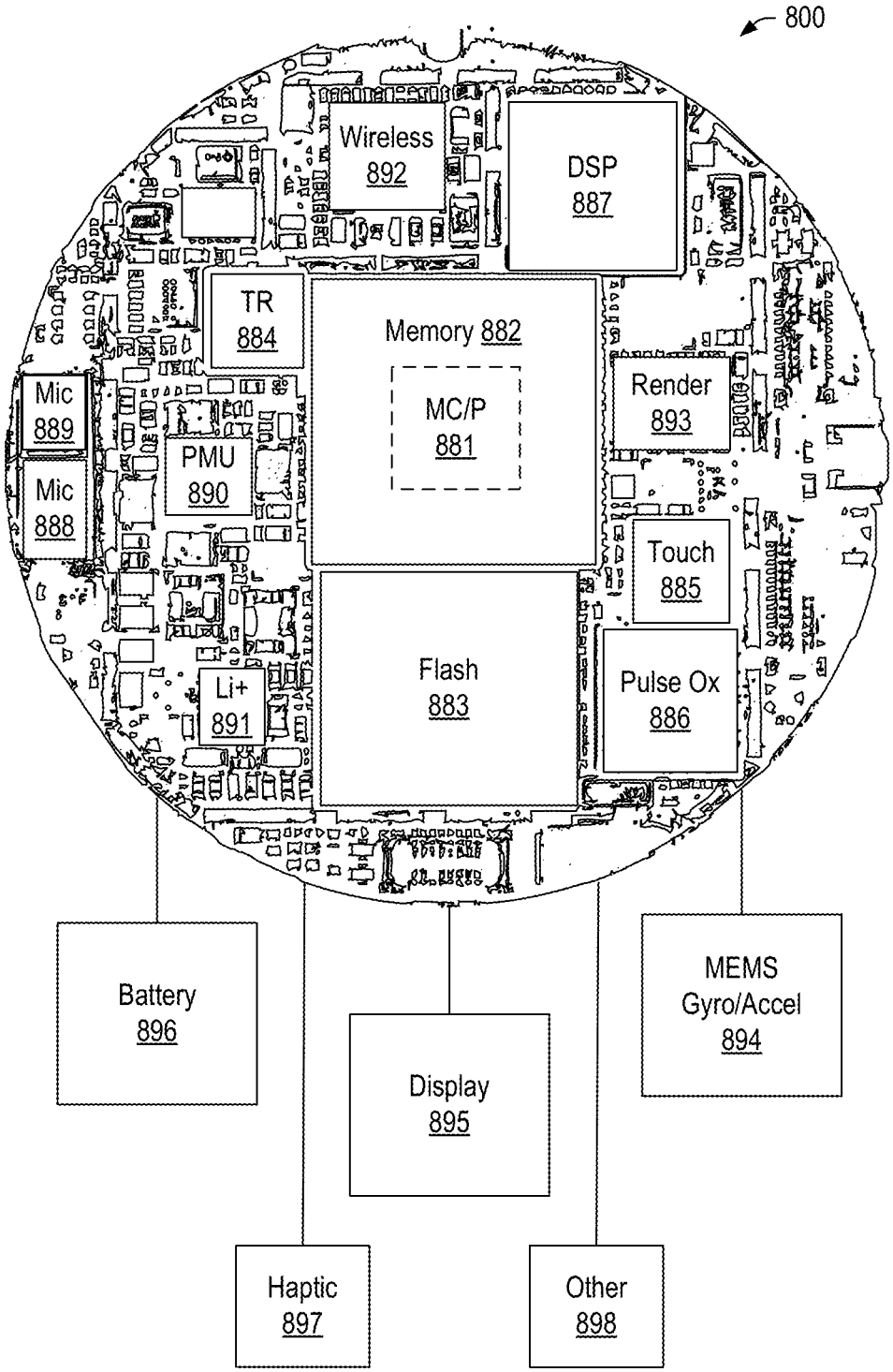
FIG. 8 is a diagram of examples of circuitry of a wearable device.

FIG. 8 shows various examples of circuitry 800 that may be included in a smart watch (e.g., a wearable device). As shown in FIG. 8, the circuitry 800 can include a microcontroller and/or processor 881, memory 882 operatively coupled to the microcontroller and/or processor 881, flash memory 883, a transceiver 884 (e.g., USB, PHY, etc.), touch sensing circuitry 885, a pulse oximeter 886, a digital signal processor (DSP) 887, a microphone 888 (e.g., top port), a microphone 889 (e.g., bottom port), a power manage unit 890, a battery charger 891, wireless communication circuitry 892, render circuitry 893, MEMS gyroscopic and/or accelerometer circuitry 894, a display 895, a battery 896, haptic circuitry 897 (e.g., vibration, etc.), and one or more other types of circuitry 898.

As an example, a wearable device can include a display that includes CORNING® GORILLA® glass and a backlit LCD. As an example, a device can be configured with a particular size and display resolution (e.g., 263 ppi (360×325), 233 ppi (360×330), etc.).

As to dimensions of a wearable device, case dimensions may be, for example, less than about 70 mm in diameter and greater than about 10 mm in diameter while thickness may be less than about 20 mm and greater than about 3 mm.

As to a processor and/or microcontroller, consider, for example, the QUALCOMM® SNAPDRAGON™ 400 with a 1.2 GHz quad-core CPU (APQ 8026). As to graphics (e.g., rendering circuitry), consider as an example the Adreno 305 with a 450 MHz GPU.

As to sensors, consider a wearable that includes one or more of an accelerometer, an ambient light sensor, a gyroscope, a vibration/haptics engine, etc.

As to a battery, consider, as an example, a 300 mAh battery, a 400 mAh battery, etc. As an example, a wearable device may include wireless charging circuitry and, for example, a charging dock.

As to memory, consider, as an example, 4 GB internal storage and 512 MB RAM. As to connectivity, consider, as an example, BLUETOOTH® 4.0 Low Energy (BLE), Wi-Fi 802.11 b/g, etc.

As an example, a wearable device may include one or more features of a MOTO 360® wearable device, which can include various fitness-tracking features. For example, consider counting steps, reading heart rate, and estimating calorie burn.

Figure 9:
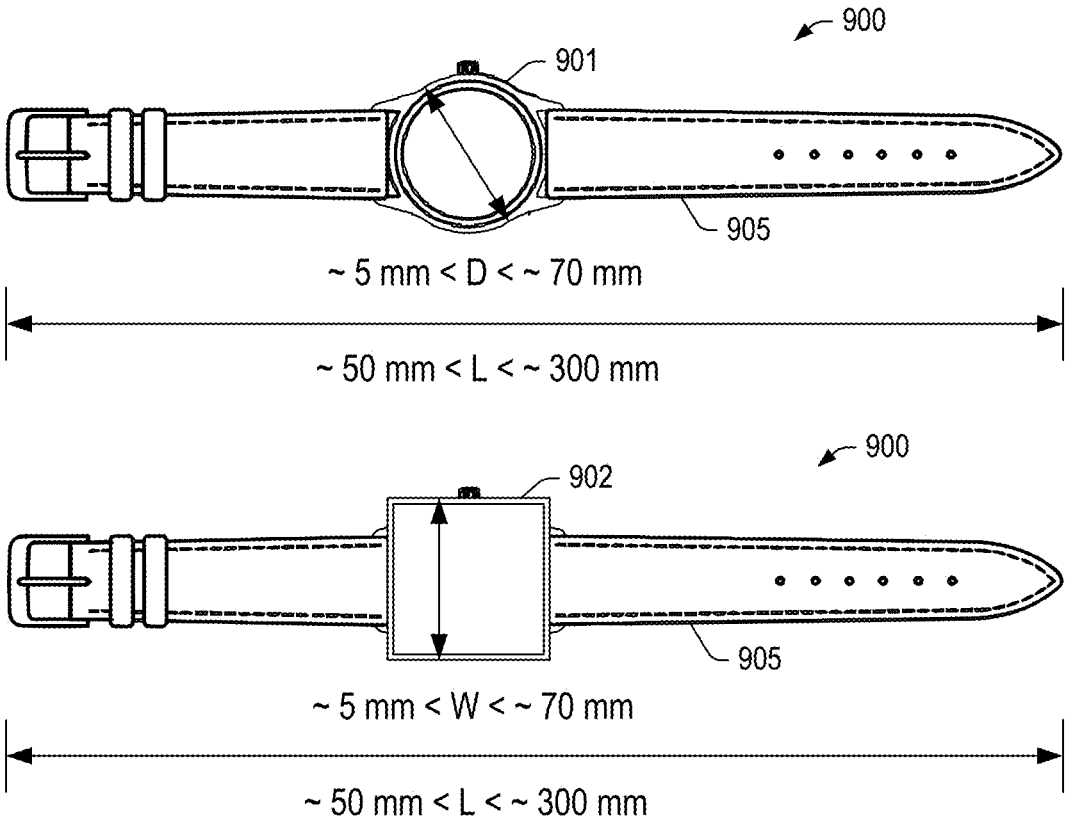
FIG. 9 is a series of diagrams of examples of wearable devices.
Figure 9:
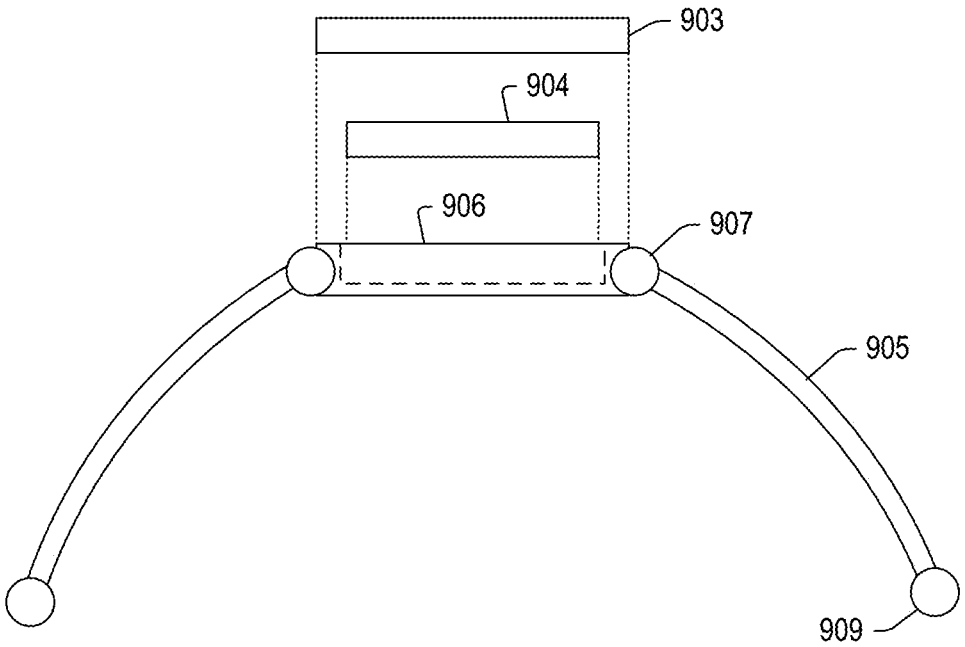

FIG. 9 shows an example of a wearable device 900 that can include a curved case 901 or a polygonal case 902. As shown, a diameter of the curved case 901 and/or a width of the polygonal case 902 can be in a range from approximately 5 mm to approximately 70 mm. As shown, a length of the wearable device 900 can be approximately 50 mm to approximately 300 mm. Such a length may depend on a circumference of a wrist of a user that wears the wearable device 900. A length can be defined in part by a strap or a band, which may include a latch.

FIG. 9 shows an approximate side view of a wearable device that includes a cover 903, circuitry 904, a band 905, a case 906, lugs 907, and a latch 909. In the example of FIG. 9, the circuitry 904 may include one or more features of the circuitry 800 of FIG. 8.

As an example, a watch can include a processor; memory operatively coupled to the processor; a display operatively coupled to the processor; an environmental sensor that generates sensor information; circuitry that selects a watch face from a plurality of different watch faces based at least in part on at least a portion of the sensor information; and circuitry that renders the selected watch face to the display. In such an example, the watch may include a plurality of environmental sensors. As to some examples of environmental sensors, consider a watch that includes one or more of an accelerometer, a geographic position sensor, a barometer, an altimeter, a thermometer, a heart rate sensor and a light sensor.

As an example, a plurality of different watch faces can include one or more user activity monitor watch faces. As an example, a plurality of different watch faces can include one or more single time zone watch faces and/or one or more multiple time zones watch faces. As an example, a plurality of different watch faces can include one or more weather information watch faces. As an example, a plurality of different watch faces can include one or more entity specific watch faces. For example, consider a workplace or employer as an entity where a specific watch face includes features associated with that entity (e.g., a stock-ticker, a logo, a color, etc.), consider a sports team as an entity where a specific watch face includes features associated with that entity (e.g., a schedule, a team roster, a score, a logo, a color, etc.), consider a musical performer or group as an entity where a specific watch face includes features associated with that entity (e.g., a song list, a tour schedule, a logo, a color, etc.), etc. As an example, an environmental sensor or sensors may determine that a watch is in an environment associated with an entity (e.g., via one or more of location, wireless signal(s), sound, lighting, temperature, etc.). As an example, a microphone of a watch may sense sound and analyze the sound to associate an entity with the sound and then select and render a watch face associated with the entity to a display of the watch. Such information may be analyzed with respect to one or more types of information such as, for example, schedule information (e.g., a work schedule, a sports team schedule, a performer/group schedule, etc.). As an example, a day, a time, a date, etc., may be one or more types of environmental information, which may be utilized for watch face selection (e.g., alone or with other information). As mentioned, a watch can include circuitry and/or mechanical components (e.g., one or more complications) that can determine (e.g., track) day, time, date, week, month, year, moon phase, time zones (e.g., GMT), etc. As an example, such circuitry and/or mechanical components may provide information that can be utilized in selection of a watch face.

As an example, a watch can include memory (e.g., a storage device for digital information) that may include at least one of a plurality of different watch faces. For example, a watch can include memory, which may optionally be removable, that can store one or more selectable watch faces. As an example, one or more watch faces may be available via wireless circuitry. For example, consider a wireless interface (e.g., wireless circuitry) of a watch that can access at least one of a plurality of different watch faces via the wireless interface. In such an example, a trigger may be part of a selection process or selection circuitry that causes wireless communication to access a watch face from a website, a local server, etc. As an example, consider a sporting event where a watch may access a team theme watch face (e.g., via a local wireless network at a stadium, etc.).

As an example, a watch can include circuitry that selects a watch face via circuitry that analyzes at least a portion of sensor information and that, based at least in part on the analysis, generates at least one trigger that triggers circuitry that renders the selected watch face. In such an example, the watch can include circuitry that stores a plurality of different triggers to the memory. Such triggers may be reviewable by a user to determine whether one or more of the triggers are to be kept, modified, enabled, disabled, etc. As an example, a watch can include memory that stores a data structure that includes entries that associate different watch faces with different environmental conditions. In such an example, the entries may be based on sensor information from one or more of a plurality of different environmental sensors. As an example, a watch can include circuitry that, responsive to one of a plurality of different environmental conditions, automatically selects an associated watch face where circuitry that renders can automatically renders the selected watch face to the display.

As an example, a method can include detecting a change in environment of a watch that includes a display; responsive to the change, selecting a watch face from a plurality of different watch faces; and rendering the selected watch face to the display. In such an example, the selecting can include accessing memory of the watch where the memory stores at least one of the plurality of different watch faces and/or accessing a network and downloading the watch face via the network. As an example, a method can include detecting a change in environment of a watch, which may include one or more of detecting a change in location of the watch, detecting a change in motion of the watch, and detecting a change in physiological condition of a wearer of the watch. As an example, a method can include detecting multiple changes where each change causes selection of a watch face (e.g., consider a first change in environment of a watch and another change in environment of the watch and rendering a different watch face to a display of the watch). As an example, a watch face can be a default watch face, which may be selected and rendered responsive to detection of a change.

As an example, a method can include populating entries of a data structure stored in memory of a watch where the entries associate different changes in environment with different watch faces. In such an example, the populating can include analyzing sensor information generated by at least one sensor of the watch. In such an example, the analyzing can include associating user watch face selections and sensor information. In such an example, user watch face selections can include historical user watch face selections where sensor information can include corresponding historical sensor information.

As an example, one or more processor-readable storage media can include processor-executable instructions that instruct a processor to: detect a change in environment of a watch that includes a display; responsive to the change, select a watch face from a plurality of different watch faces; and render the selected watch face to the display.

As described herein, various acts, steps, etc., may be implemented as instructions stored in one or more computer-readable storage media or processor-readable storage media where a computer-readable storage medium and a processor-readable storage medium is not a signal or a carrier wave. For example, one or more computer-readable storage media or processor-readable storage media can include computer-executable instructions or processor-executable instructions to instruct a device, which can be a watch (e.g., a wearable device).

The term "circuit" or "circuitry" is used in the summary, description, and/or claims. As is well known in the art, the term "circuitry" includes all levels of available integration, e.g., from discrete logic circuits to the highest level of circuit integration such as VLSI, and includes programmable logic components programmed to perform the functions of an embodiment as well as general-purpose or special-purpose processors programmed with instructions to perform those functions. Such circuitry may optionally rely on one or more computer-readable media that includes computer-executable instructions. As described herein, a computer-readable medium may be a storage device (e.g., a memory chip, a memory card, a storage disk, etc.) and referred to as a computer-readable storage medium. Circuitry is a physical component that is non-transitory and not a carrier wave.

Figure 10:
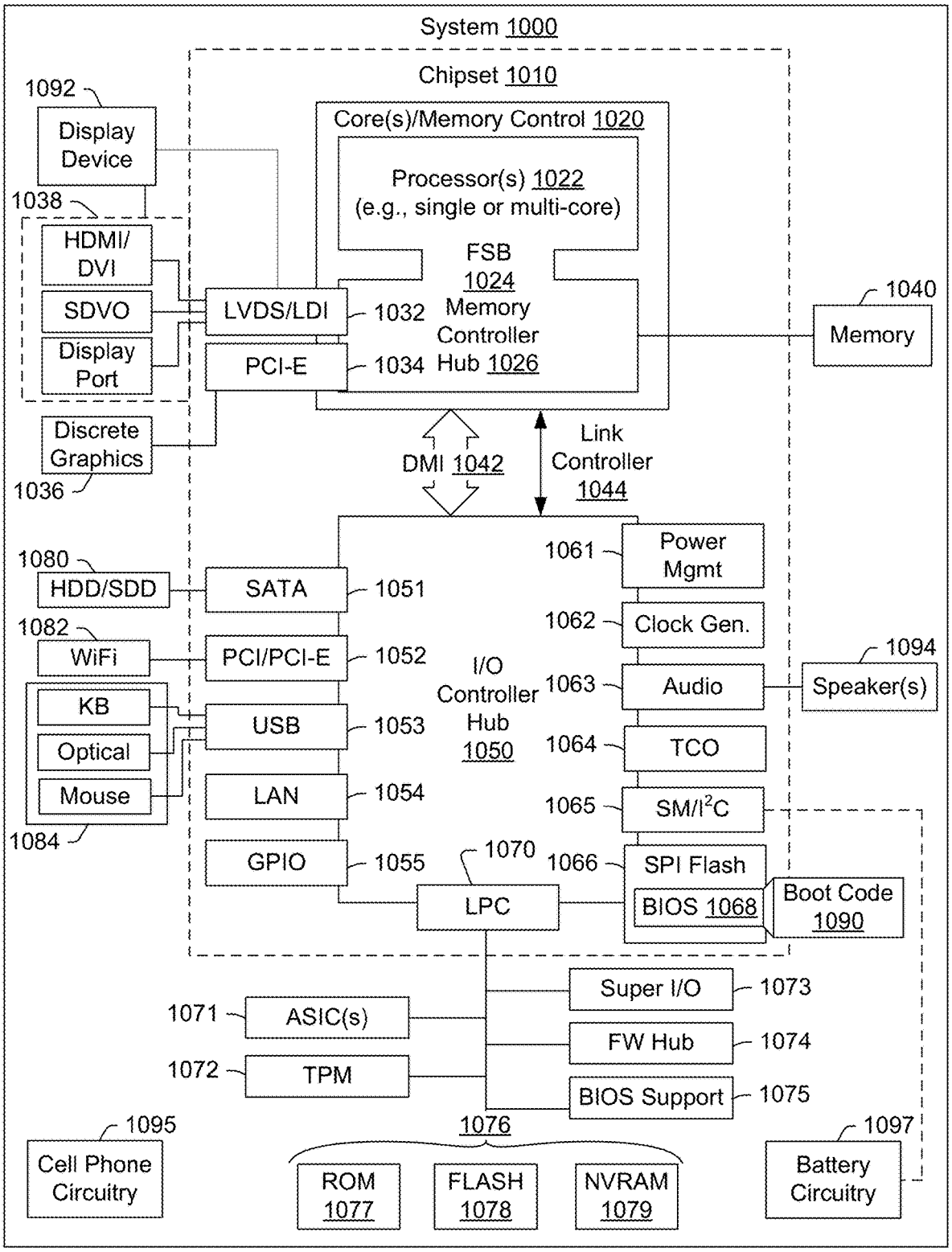
FIG. 10 is a diagram of an example of a system.

While various examples of circuits or circuitry have been discussed, FIG. 10 depicts a block diagram of an illustrative computer system 1000. The system 1000 may be a desktop computer system, such as one of the ThinkCentre® or ThinkPad® series of personal computers sold by Lenovo (US) Inc. of Morrisville, N.C., or a workstation computer, such as the ThinkStation®, which are sold by Lenovo (US) Inc. of Morrisville, N.C.; however, as apparent from the description herein, a satellite, a base, a server or other machine may include other features or only some of the features of the system 1000. As an example, a device such as one of the devices of FIG. 1, FIG. 2, FIG. 3, FIG. 5, FIG. 6, FIG. 7, FIG. 8, FIG. 9, etc. may include at least some of the features of the system 1000.

As shown in FIG. 10, the system 1000 includes a so-called chipset 1010. A chipset refers to a group of integrated circuits, or chips, that are designed (e.g., configured) to work together. Chipsets are usually marketed as a single product (e.g., consider chipsets marketed under the brands INTEL®, AMD®, etc.).

In the example of FIG. 10, the chipset 1010 has a particular architecture, which may vary to some extent depending on brand or manufacturer. The architecture of the chipset 1010 includes a core and memory control group 1020 and an I/O controller hub 1050 that exchange information (e.g., data, signals, commands, etc.) via, for example, a direct management interface or direct media interface (DMI) 1042 or a link controller 1044. In the example of FIG. 10, the DMI 1042 is a chip-to-chip interface (sometimes referred to as being a link between a "northbridge" and a "southbridge").

The core and memory control group 1020 include one or more processors 1022 (e.g., single core or multi-core) and a memory controller hub 1026 that exchange information via a front side bus (FSB) 1024. As described herein, various components of the core and memory control group 1020 may be integrated onto a single processor die, for example, to make a chip that supplants the conventional "northbridge" style architecture.

The memory controller hub 1026 interfaces with memory 1040. For example, the memory controller hub 1026 may provide support for DDR SDRAM memory (e.g., DDR, DDR2, DDR3, etc.). In general, the memory 1040 is a type of random-access memory (RAM). It is often referred to as "system memory".

The memory controller hub 1026 further includes a low-voltage differential signaling interface (LVDS) 1032. The LVDS 1032 may be a so-called LVDS Display Interface (LDI) for support of a display device 1092 (e.g., a CRT, a flat panel, a projector, etc.). A block 1038 includes some examples of technologies that may be supported via the LVDS interface 1032 (e.g., serial digital video, HDMI/DVI, display port). The memory controller hub 1026 also includes one or more PCI-express interfaces (PCI-E) 1034, for example, for support of discrete graphics 1036. Discrete graphics using a PCI-E interface has become an alternative approach to an accelerated graphics port (AGP). For example, the memory controller hub 1026 may include a 16-lane (×16) PCI-E port for an external PCI-E-based graphics card. A system may include AGP or PCI-E for support of graphics. As described herein, a display may be a sensor display (e.g., configured for receipt of input using a stylus, a finger, etc.). As described herein, a sensor display may rely on resistive sensing, optical sensing, or other type of sensing.

The I/O hub controller 1050 includes a variety of interfaces. The example of FIG. 10 includes a SATA interface 1051, one or more PCI-E interfaces 1052 (optionally one or more legacy PCI interfaces), one or more USB interfaces 1053, a LAN interface 1054 (more generally a network interface), a general purpose I/O interface (GPIO) 1055, a low-pin count (LPC) interface 1070, a power management interface 1061, a clock generator interface 1062, an audio interface 1063 (e.g., for speakers 1094), a total cost of operation (TCO) interface 1064, a system management bus interface (e.g., a multi-master serial computer bus interface) 1065, and a serial peripheral flash memory/controller interface (SPI Flash) 1066, which, in the example of FIG. 10, includes BIOS 1068 and boot code 1090. With respect to network connections, the I/O hub controller 1050 may include integrated gigabit Ethernet controller lines multiplexed with a PCI-E interface port. Other network features may operate independent of a PCI-E interface.

The interfaces of the I/O hub controller 1050 provide for communication with various devices, networks, etc. For example, the SATA interface 1051 provides for reading, writing or reading and writing information on one or more drives 1080 such as HDDs, SDDs or a combination thereof. The I/O hub controller 1050 may also include an advanced host controller interface (AHCI) to support one or more drives 1080. The PCI-E interface 1052 allows for wireless connections 1082 to devices, networks, etc. The USB interface 1053 provides for input devices 1084 such as keyboards (KB), one or more optical sensors, mice and various other devices (e.g., microphones, cameras, phones, storage, media players, etc.). One or more other types of sensors may optionally rely on the USB interface 1053 or another interface (e.g., $I^2C$, etc.). As to microphones, the system 1000 of FIG. 10 may include hardware (e.g., audio card) appropriately configured for receipt of sound (e.g., user voice, ambient sound, etc.).

In the example of FIG. 10, the LPC interface 1070 provides for use of one or more ASICs 1071, a trusted platform module (TPM) 1072, a super I/O 1073, a firmware hub 1074, BIOS support 1075 as well as various types of memory 1076 such as ROM 1077, Flash 1078, and non-volatile RAM (NVRAM) 1079. With respect to the TPM 1072, this module may be in the form of a chip that can be used to authenticate software and hardware devices. For example, a TPM may be capable of performing platform authentication and may be used to verify that a system seeking access is the expected system.

The system 1000, upon power on, may be configured to execute boot code 1090 for the BIOS 1068, as stored within the SPI Flash 1066, and thereafter processes data under the control of one or more operating systems and application software (e.g., stored in system memory 1040). An operating system may be stored in any of a variety of locations and accessed, for example, according to instructions of the BIOS 1068. Again, as described herein, a satellite, a base, a server or other machine may include fewer or more features than shown in the system 1000 of FIG. 10. Further, the system 1000 of FIG. 10 is shown as optionally include cell phone circuitry 1095, which may include GSM, CDMA, etc., types of circuitry configured for coordinated operation with one or more of the other features of the system 1000. Also shown in FIG. 10 is battery circuitry 1097, which may provide one or more battery, power, etc., associated features (e.g., optionally to instruct one or more other components of the system 1000). As an example, a SMBus may be operable via a LPC (see, e.g., the LPC interface 1070), via an $I^2C$ interface (see, e.g., the SM/$I^2C$ interface 1065), etc.

Although examples of methods, devices, systems, etc., have been described in language specific to structural features and/or methodological acts, it is to be understood that the subject matter defined in the appended claims is not necessarily limited to the specific features or acts described. Rather, the specific features and acts are disclosed as examples of forms of implementing the claimed methods, devices, systems, etc.

What is claimed is:

1. A watch comprising:

a processor;

memory operatively coupled to the processor;

a display operatively coupled to the processor;

motion sensor that generates motion signals with respect to time responsive to motion of the watch;

circuitry that generates contextual information based at least in part on the motion signals with respect to time and that classifies the contextual information into a plurality of different classifications for association with a plurality of different watch faces, wherein the plurality of different classifications comprise a plurality of different user activity classifications that are distinguishable using the motion signals with respect to time, wherein the plurality of different watch faces comprise a plurality of different user activity monitor watch faces, and wherein each of the plurality of different user activity monitor watch faces comprises a corresponding activity metric derived at least in part from the motion signals with respect to time;

circuitry that automatically selects a watch face from the plurality of different watch faces responsive to an indication of one of the plurality of different classifications via classified contextual information; and circuitry that renders the selected watch face to the display.

2. The watch of claim 1 comprising a plurality of environmental sensors.

3. The watch of claim 2 wherein at least one of the environmental sensors comprises a geographic position sensor.

4. The watch of claim 1 wherein the plurality of different watch faces comprises a single time zone watch face and a multiple time zones watch face.

5. The watch of claim 1 wherein the plurality of different watch faces comprises a weather information watch face.

6. The watch of claim 1 wherein the plurality of different watch faces comprises an entity specific watch face.

7. The watch of claim 1 wherein at least one of the plurality of different watch faces are stored in the memory.

8. The watch of claim 1 comprising circuitry that accesses at least one of the plurality of different watch faces via a wireless interface.

9. The watch of claim 1 wherein the indication of the one of the plurality of different classifications is a trigger that triggers the circuitry that renders the selected watch face.

10. The watch of claim 9 comprising circuitry that stores a plurality of different triggers to the memory.

11. The watch of claim 1 comprising a data structure that comprises entries that associate the plurality of different watch faces with the plurality of different classifications.

12. The watch of claim 11 wherein the entries are based on sensor information from a plurality of different environmental sensors.

13. The watch of claim 12 wherein the circuitry that renders, automatically renders the selected watch face to the display.

14. The watch of claim 1 wherein the plurality of different watch faces comprises an unknown activity watch face for touch input to select a user activity from a plurality of user activities, wherein the circuitry that automatically selects a watch face from the plurality of different watch faces renders the unknown activity watch face responsive to an inability to adequately resolve the motion signals with respect to time to distinguish a type of activity that corresponds to one of the plurality of different user activity classifications.

15. The watch of claim 1 wherein the motion signals with respect to time comprise peaks.

16. The watch of claim 1 wherein the plurality of different user activity monitor watch faces comprises a user activity monitor watch face with an activity graphic that indicates a type of user activity, wherein the corresponding activity metric is unique to that type of user activity.

17. The watch of claim 1 comprising circuitry that, responsive to the indication of the one of the plurality of different classifications being one of the plurality of different user activity classifications, automatically stores corresponding, derived activity metrics to the memory.

18. The watch of claim 1 comprising a light sensor and a spectral power analyzer that analyzes sensed light as to spectral power at different wavelengths with respect to time to determine a change in weather, wherein, responsive to a determined change in weather, the circuitry that automatically selects a watch face from the plurality of different watch faces automatically selects a weather themed watch face that comprises a field for rendering of weather service warning information.

19. A method comprising:

acquiring motion signals with respect to time via a motion sensor responsive to motion of a watch;

generating contextual information based at least in part on the motion signals with respect to time;

classifying the contextual information into one of a plurality of different classifications for association with a plurality of different watch faces, wherein the plurality of different classifications comprise a plurality of different known user activity classifications that are distinguishable using the motion signals with respect to time, wherein the plurality of different watch faces comprise a plurality of different user activity monitor watch faces, and wherein each of the plurality of different user activity monitor watch faces comprises a corresponding activity metric derived at least in part from the motion signals with respect to time;

automatically selecting a watch face from the plurality of different watch faces responsive to an indication of the one of the plurality of different classifications; and rendering the selected watch face to the display.

20. One or more processor-readable storage media comprising processor-executable instructions that instruct a processor to:

acquire motion signals with respect to time via a motion sensor responsive to motion of a watch;

generate contextual information based at least in part on the motion signals with respect to time;

classify the contextual information into one of a plurality of different classifications for association with a plurality of different watch faces, wherein the plurality of different classifications comprise a plurality of different known user activity classifications that are distinguishable using the motion signals with respect to time, wherein the plurality of different watch faces comprise a plurality of different user activity monitor watch faces, and wherein each of the plurality of different user activity monitor watch faces comprises a corresponding activity metric derived at least in part from the motion signals with respect to time;

automatically select a watch face from the plurality of different watch faces responsive to an indication of the one of the plurality of different classifications; and render the selected watch face to the display.

* * * * *